US006860291B2

(12) United States Patent
Rüb

(10) Patent No.: US 6,860,291 B2
(45) Date of Patent: Mar. 1, 2005

(54) DIRECTIONAL CONTROL VALVE COMPRISING AN INTERNAL PRESSURE REGULATOR

(75) Inventor: Winfried Rüb, Waldshut-Tiengen (DE)

(73) Assignee: Bucher Hydraulics GmbH, Klettgau (DE)

( * ) Notice: Subject to any disclaimer, the term of this patent is extended or adjusted under 35 U.S.C. 154(b) by 0 days.

(21) Appl. No.: 10/474,402

(22) PCT Filed: Mar. 13, 2002

(86) PCT No.: PCT/IB02/00759

§ 371 (c)(1),
(2), (4) Date: Oct. 9, 2003

(87) PCT Pub. No.: WO02/088550

PCT Pub. Date: Nov. 7, 2002

(65) Prior Publication Data

US 2004/0094210 A1 May 20, 2004

(30) Foreign Application Priority Data

Apr. 17, 2001 (CH) ..... 0699/01

(51) Int. Cl.[7] ..... F15B 13/04
(52) U.S. Cl. ..... 137/596; 91/446; 137/625.68
(58) Field of Search ..... 91/446; 137/596, 137/625.68

(56) References Cited

U.S. PATENT DOCUMENTS

| | | | |
|---|---|---|---|
| 4,719,753 | A | 1/1988 | Kropp |
| 5,446,979 | A | 9/1995 | Sugiyama et al. |
| 6,516,614 | B1 | 2/2003 | Knoll |

FOREIGN PATENT DOCUMENTS

| | | |
|---|---|---|
| DE | 198 36 564 | 2/2000 |

*Primary Examiner*—Gerald A. Michalsky
(74) *Attorney, Agent, or Firm*—Cohen, Pontani, Lieberman & Pavane

(57) ABSTRACT

A directional control valve includes a pressure regulator piston configured as a hollow slide with a radial passage positioned in such a way that a connection from the internal chamber of the pressure regulator piston to a pump pressure annular channel (P) can be regulated by the radial passage and a second radial passage of a directional control valve piston. The second radial passage constitutes a control edge, which is used to regulate the connection from the internal chamber to a load sensing annular channel (LS). An annular groove, which in the neutral position forms a connection from the internal chamber to the load sensing annular channel (LS), is joined to the second radial passage. The pressure regulator is impervious to different flow forces caused by different mass fluxes and ensures that the hydraulic consumer is prevented from moving in the neutral position.

8 Claims, 2 Drawing Sheets

DIRECTIONAL CONTROL VALVE COMPRISING AN INTERNAL PRESSURE REGULATOR

PRIORITY CLAIM

This is a U.S. national stage of application No. PCT/IB02/00759, filed on 13 Mar. 2002. Priority is claimed on that application and on the following application: Country: Switzerland, Application No.: 0699/01, Filed: 17 Apr. 2001.

BACKGROUND OF THE INVENTION

1. Field of the Invention

The invention relates to a directional valve with internal pressure regulator of the type having a valve housing having a longitudinal bore in which a plurality of coaxial annular ducts are recessed, the annular ducts including a pump-pressure duct and a load sensing duct; a directional valve piston which is axially displaceable in the longitudinal bore, the directional valve having an axial bore with a first radial perforation, a second radial perforation which axially spaced from the first radial perforation and a closed end; and a pressure regulator piston which is axially displaceable in the axial bore, the pressure regulator piston having a control edge, a closed end wall, an inner space with an inside diameter, and at least one radial perforation which permanently connects the inner space to the second radial perforation in the directional valve piston. A pressure regulator spring space between the closed end wall of the pressure regulator piston and the closed end of said directional valve piston, which space contains a spring which loads the closed end wall away from the closed end, is permanently connected to the load sensing duct.

2. Description of the Related Art

Such directional valves are used advantageously in mobile hydraulics for the activation of hydraulic consumers in agricultural and construction vehicles.

A directional valve of this type is disclosed in U.S. Pat. No. 6,516,614. The directional valve has an internal pressure regulator which is designed as a hollow slide. The latter has a radial perforation which is permanently connected to a radial perforation of the valve piston. Moreover, the value has an annular load-sensing duct which is permanently connected to a spring space of the pressure regulator. By virtue of the design of the directional valve, the pressure drop across a measuring diaphragm can be kept constant.

A similar directional value is also known from DE-A1-198 36 564. Here, too, a pressure regulator is arranged within the slide piston designed as a hollow piston. In order to solve the existing problem of the action of flow forces on the behavior of the directional valve, it is proposed, here, to provide on the pressure regulator piston a second control edge, by means of which an additional pressure medium flow to the working connection can be generated. By means of this compensation flow, flow forces on the pressure regulator piston and on the slide piston are to be minimized. This is also intended, in particular, to improve the response behavior of the directional valve, for example when raising and lowering operations are being initiated on power-operated lifting appliances.

The implementation of an additional control edge entails, in principle, an extra outlay in fabrication terms. The compensation of flow forces is also incomplete whenever the flows differ in their magnitude. Thus, for example, when the hydraulic consumer is a differential cylinder, the mass flow of the hydraulic medium at the two working connections A and B of the directional valve is necessarily different. In addition, such differential cylinders may themselves have different mass flow conditions in the inflow and outflow. As well as this, however, there is also a further problem: in the "neutral" position, the pressure regulator piston is to assume an unequivocal closing position. However, this is often prevented due to the fact that uncontrollable pressures build up as a result of leakages. Leakages between those annular ducts of the directional valve which have different pressures are unavoidable, and, because of fabrication tolerances, the size of these leakages cannot be foreseen. In the worst case, a movement of the consumer may consequently occur, even though this should be stationary.

SUMMARY OF THE INVENTION

The object on which the invention is based is to provide a directional valve, the pressure regulator of which is insensitive to different flow forces caused by different mass flows and at the same time ensures that a movement of the hydraulic consumer cannot occur in the "neutral" position.

DETAILED DESCRIPTION OF THE PRESENTLY PREFERRED EMBODIMENTS

Figure 1:
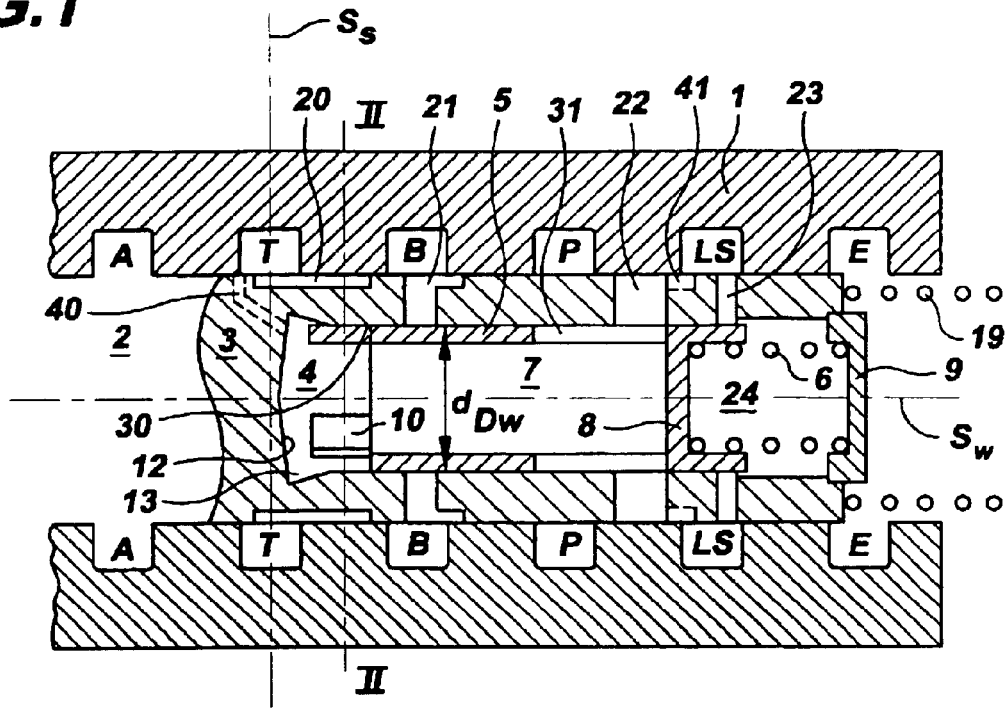
FIG. 1 shows a sectional illustration of a directional valve piston with internal pressure regulator in a valve housing.

FIG. 1 shows, by a reference numeral 1, a part of a valve housing which has a longitudinal bore 2. It is indicated by a horizontal axis of symmetry $S_w$ and a vertical axis of symmetry $S_s$ that the valve housing 1 and also a directional valve piston 3 displaceable in the longitudinal bore 2 have a biaxially symmetrical construction. The directional valve piston 3 is a hollow slide. Various annular ducts are pierced in the valve housing 1 from the longitudinal bore 2, to be precise, at the symmetry center point, an annular tank-connection duct T which is followed from the vertical axis of symmetry $S_s$, in the direction of the end face of the valve housing 1, by further annular ducts, to be precise, to the left, an annular working-connection duct A and, to the right, an annular working-connection duct B. These two annular working-connection ducts A, B are connected to the load connections of the directional valve which are designated conventionally by "A" and "B".

The annular working-connection duct B is followed, to the right, by annular pump-pressure duct P, then an annular load-sensing duct LS and finally an annular end-space duct E. The same succession of annular ducts is also present to the left, but is not illustrated in FIG. 1.

The directional valve piston 3 has, in turn, an axial bore 4, in which a pressure regulator piston 5 is axially displaceable counter to a pressure regulator spring 6. The illustration of FIG. 1 shows the directional valve piston 3 in the neutral position, in which there is neither a connection to the annular tank-connection duct T nor a connection to the annular pump-pressure duct P from the annular working-connection ducts A and B. The hydraulic consumer connected to the load connections of the directional valve, which, as mentioned, are designated by "A" and "B", is consequently stationary.

The pressure regulator piston 5 is likewise a hollow slide, that is to say surrounds an inner space 7 which is open towards the vertical axis of symmetry $S_s$, but on the other side has a closed end wall 8.

The directional valve piston 3 is likewise closed on the end face, for example by means of a screw-in closing cap 9. The pressure regulator spring 6, already mentioned, is arranged between the closing cap 9 of the directional valve piston 3 and the end wall 8 of the pressure regulator piston 5.

Figure 2:
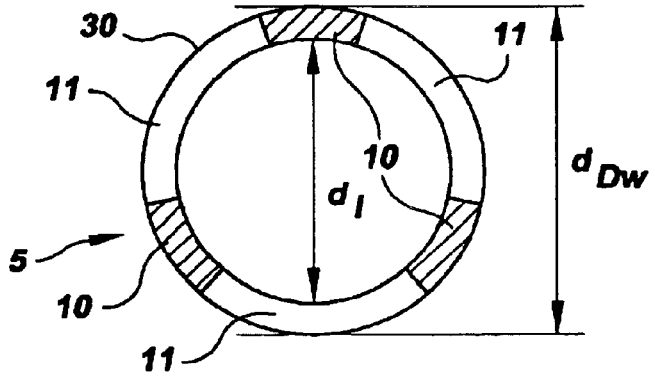
FIG. 2 shows a partially sectional view of a pressure regulator piston.

On the open left side, the pressure regulator piston 5 has control ribs 10. These form extensions of the cylindrical part of the pressure regulator piston 5. In order to make their shape and position clear, a sectional line II—II is depicted, the corresponding section being illustrated in FIG. 2. FIG. 2 shows the control ribs 10 in section, while the end faces of the pressure regulator piston 5 which lie between them are shown in a top view. The interspaces between the control ribs 10, said interspaces being in the form of a ring segment, are designated as fine control notches 11.

The significance of the shape of the end face 12 of the axial bore 4 with a following cross-sectional widening 13 in the axial bore 4 is dealt with later.

Elements essential for the functioning of the directional valve are additionally depicted in FIG. 1. The reference numeral 19 designates a control spring which acts on the directional valve piston 3 from a drive, not illustrated. Essential to functioning are tank control grooves 20 which are milled in the outer surface of the directional valve piston 3 and serve, in the appropriate relative position of the directional valve piston 3 in relation to the valve housing 1, to allow the hydraulic medium to flow from the annular working-connection duct B or annular working-connection duct A to the annular tank-connection duct T, this characterizing the two working positions of the directional valve. If, for example, the directional valve piston 3 is displaced to the right out of the position shown in FIG. 1, the connection between the annular working-connection duct B and the annular tank-connection duct T is made via the tank control groove 20.

Also essential to functioning are a first radial valve-piston perforation 21 and a second radial valve-piston perforation 22, the functional significance of which is also dealt with. Moreover, in the cylindrical casing of the directional valve piston 3, connecting bores 23 are arranged, by means of which a permanent connection between the annular load-sensing duct LS and the space surrounding the pressure regulator spring 6 and designated as a pressure regulator spring space 24 is made. So that there is this connection in all the positions of the pressure regulator piston 5 within the directional valve piston 3, for example, the inside diameter of the directional valve piston 3 is larger in the region of the pressure regulator spring space 24 than the outside diameter of the pressure regulator piston 5. There may, however, also be other means, for example longitudinal grooves, to ensure this permanent connection between the annular load-sensing duct LS and the pressure regulator spring space 24. As a result, under all circumstances, the pressure prevailing in the annular load-sensing duct LS acts in the pressure regulator spring space 24, thus ensuring according to the invention, in cooperation with the pressure regulator spring 6, that the pressure regulator piston 5 assumes an unequivocal position in which the pressure regulator piston 5 reliably shuts off the annular working-connection duct B, thereby achieving that part of the object whereby a movement of the hydraulic consumer cannot occur in the "neutral" position. The pressure regulator spring space 24 is a control pressure space in functional terms. It is essential to the invention that no control edge which could adversely influence the pressure in the pressure regulator spring space 24 lies between the annular load-sensing duct LS and the pressure regulator spring space 24. The circumferential line of the pressure regulator piston 5 in the region of the fine control notches 10 acts as the first control edge 30 of the pressure regulator piston 5. A feature known per se from the prior art is essential to the invention, to be precise that the pressure regulator piston 5 has at least one radial perforation 31 in its cylindrical casing. Advantageously, however, a plurality of such radial perforations 31 are present, which are distributed uniformly on the circumference of the pressure regulator piston 5. Each of the radial perforations 31 is in the form of an elongate slot.

The radial perforations 31 act as a second control edge of the pressure regulator piston 5. They are permanently connected to the radial valve-piston perforation 22. When the pressure in the axial bore 4 of the directional valve piston and in the inner space 7 of the pressure regulator piston 5 rises so high that the force occurring as a result of this pressure and acting on the pressure regulator piston 5 becomes greater than the sum of the force of the pressure regulator spring 6 and of the force acting on the pressure regulator piston 5 from the pressure in the pressure regulator spring space 24, then the pressure regulator piston 5 moves to the right counter to the pressure regulator spring 6 until there is a force equilibrium again. The sufficiently high pressure in the axial bore 4 of the directional valve piston 3 and in the inner space 7 of the pressure regulator piston 5, the pressure regulator piston 5 moves to the right counter to the pressure regulator spring 6 until the axial bore 4 of the directional valve piston 3 and the inner space 7 of the pressure regulator piston 5 are connected to the pressure regulator spring space 24, as will also be shown.

Moreover, in FIGS. 1 and 2, a diameter $d_{Dw}$ which designates the outside diameter of the pressure regulator piston 5 is also depicted. This diameter $d_{Dw}$ determines the hydrostatic force effect which occurs as a result of the pressure prevailing in the pressure regulator spring space 24, by virtue of the area $d_{Dw}^2 \cdot \pi/4$, since this area is the effective control pressure surface. In FIG. 2, moreover, the inside diameter of the pressure regulator piston 5 is depicted and is designated by $d_I$. The extent to which this inside diameter $d_I$ is important will also be explained.

Figure 3:
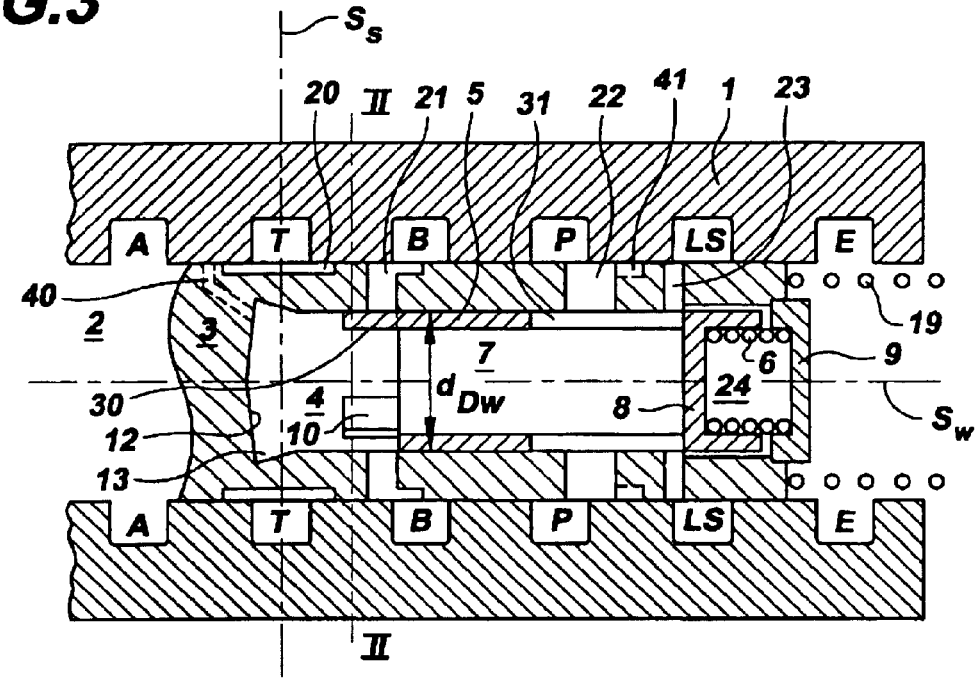
FIG. 3 shows an illustration similar to FIG. 1, but in a working position of the directional valve.

FIG. 3 shows a working position of the directional valve piston 3. By means of a drive which is present in such directional valves and is not shown in all the figures, the directional valve piston 3 is displaced to the left within the valve housing 1. There is consequently a throughflow from the annular pump-pressure duct P to the annular working-connection duct B. Hydraulic medium can then flow from the annular pump-pressure duct P through the second radial valve-piston perforation 22 of the directional valve piston 3 and through the radial perforation 31 of the pressure regulator piston 5 into the inner space 7 of the pressure regulator piston 5 and from there further on into the axial bore 4 of the directional valve piston 3 and further on through the first radial valve-piston perforation 21 into the annular working-connection duct B. The possible flow of hydraulic medium is marked by three dotted lines, from which it becomes clear that the flow of hydraulic medium is distributed over the entire free cross section in the inner space 7 of the pressure regulator piston 5 and in the axial bore 4 of the directional valve piston 3. For the sake of clarity, this sectional diagram shows only the flow lines emanating from that part of the annular pump-pressure duct P which is shown on the bottom. However, since the ducts present in the valve housing 1 are always continuous annular ducts, the flow of hydraulic medium is distributed over the entire annular surfaces. It is important here, then, that the inside diameter $d_f$ of the pressure regulator piston 5 is relatively large, the result of this being that the flow velocity in the inner space 7 of the pressure regulator piston 5 is relatively low. This also applies to the flow in the axial bore 4 of the directional valve piston 3. On account of the low velocity, the hydrodynamic forces are low. This has the effect, in accordance with the set object, that the pressure regulator is insensitive to different flow forces caused by different mass flows.

As a result of the opening of the second radial valve-piston perforation 22 of the directional valve piston 3 to the annular pump-pressure duct P, a pressure corresponding approximately to the pump pressure arises in the inner space 7 of the pressure regulator piston 5. This pressure then acts counter to the pressure which prevails in the pressure regulator spring space 24 and which is correlated to the pressure in the annular load-sensing duct LS. The pressure regulator piston 5 is moved correspondingly counter to the pressure regulator spring 6, so that the position, shown in FIG. 3, of the pressure regulator piston 5 within the directional valve piston 3 is obtained, as was already indicated above. The actual position of the pressure regulator piston 5 within the directional valve piston 3 is governed by the difference in the force effects which occur from the pressures in the annular pump-pressure duct P and in the annular load-sensing duct LS.

In the first step, the pressure regulator piston 5, via its control ribs 10, opens the connection between the radial valve-piston perforation 21 and the axial bore 4 of the directional valve piston 3, so that a defined outflow cross section is obtained at the radial valve-piston perforation 21. When the pressure in the annular working-connection duct B is high, according to the pressure of the corresponding load connection of the consumer, and the resultant pressure force at the pressure regulator piston 5 overcomes the sum of the pressure in the pressure regulator spring space 24 and of the force of the pressure regulator spring 6, the pressure in the inner space 7 of the pressure regulator piston 7 then builds up to the pressure in the annular working-connection duct B and moves the pressure regulator piston 5 counter to the pressure regulator spring 6 as far to the right as is shown in FIG. 3. In this case, the pressure regulator spring space 24 is then connected to the inner space 7 of the pressure regulator piston 5. The pressure in the annular load-sensing duct LS follows this value on account of the connection from the inner space 7 of the pressure regulator piston 5 via the connecting bores 23 to the annular load-sensing duct LS. The movement of the consumer then takes place in a known way as a result of the action of a pump governor, not illustrated. The pump governor raises the pump pressure exactly to an extent such that, via the set throttle cross section of the second radial valve-piston perforation 22 of the directional valve piston 3, because of the defined throughflow quantity of hydraulic medium, the pressure drop is exactly as high as the "pump pressure minus control pressure" difference predetermined by the pump governor.

A second step in the pressure regulator control takes place when the pressure in the annular working-connection duct B, corresponding to the pressure at the corresponding load connection to the consumer, is lower than the pump pressure.

Due to the hydraulic medium flowing out, the pressure in the inner space 7 of the pressure regulator piston 5 falls so far that, under the influence of the pressure regulator spring 6, in conjunction with the pressure in the pressure regulator spring space 24, the pressure regulator piston 5 moves to the left until the control ribs 10 have reduced the outflow cross section at the radial valve-piston perforation 21 until the pressure which has then built up again in the inner space 7 of the pressure regulator piston 5 is in force equilibrium with the forces which result from the action of the pressure in the pressure regulator spring space 24 and from the pressure regulator spring 6.

It has already been mentioned above that the inside diameter $d_f$ of the pressure regulator piston 5 is significant. The maximum throughflow of hydraulic medium through the pressure regulator occurs when there is the largest effective opening cross section for the radial perforation 22 as a result of the relative position of the second radial valve-piston perforation 22 of the direction valve piston 3 in relation to the annular pump-pressure duct P. When the inside diameter $d_f$ of the pressure regulator piston 5 is large, there is in this case a low axial flow velocity in the inner space 7 of the pressure regulator piston 5, with correspondingly low jet forces. It is proved advantageous if the inside diameter $d_f$ is dimensioned such that the area $d_f^2 \cdot \pi/4$ is about three to five times the area of the radial perforation 22.

According to the invention, the pressure regulator spring space 24 is fundamentally and continuously connected to the annular load-sensing duct LS. The pressure in the inner space 7 of the pressure regulator piston 5 may be different, depending on the working position of the directional valve piston 3. In the neutral position shown in FIG. 1, it is indeterminate. In order to ensure that, even in this position, the inner space 7 of the pressure regulator piston 5 has a defined pressure, it is advantageous to provide a pressure release bore 40, by means of which, in the neutral position of the directional valve piston 3, the axial bore 4 of the directional valve piston 3 and therefore also the inner space 7 of the pressure regulator piston 5 are connected to the annular tank-connection duct T. By means of the pressure release bore 40, therefore, the inner space 7 of the pressure regulator piston 5 can be connected to the annular tank-connection duct T, but is connected only in the neutral position. Since, when the consumer is in operation, the pressure in the annular tank-connection duct T is fundamentally lower than the pressure in the annular load-sensing duct LS, what is thus achieved is that the pressure regulator piston 5 does not assume the desired unequivocal position solely owing to the action of the pressure regulator spring 6, but is also assisted by the pressure difference between the annular load-sensing duct LS and the annular tank-connection duct T. Problems due to leakage pressure losses thus, arise.

An alternative possibility for achieving the desired unequivocal position of the pressure regulator piston 5 in the neutral position by an unequivocal fixing of the pressure in the inner space 7 of the pressure regulator piston 5 is to connect the inner space 7 to the annular load-sensing duct LS in the neutral position. The pressure regulator spring 6 then alone determines the unequivocal position of the pressure regulator piston 5 in the neutral position. Problems due to leakage pressure losses thus also cannot arise. Connection of the inner space 7 to the annular load-sensing duct LS is achieved, according to the invention, in that the radial valve-piston perforation 22 is given a different shape. In FIGS. 1 and 3, broken lines show an annular groove 41 which directly adjoins the radial valve-piston perforation 22.

It can be seen from FIG. 1 that, by means of this annular groove 41 adjoining the radial valve-piston perforation 22, a connection from the inner space 7 to the annular load-sensing duct LS is made, while it can be seen from FIG. 3 that this annular groove 41 is ineffective in the working position of the directional valve piston 3. This solution according to the invention with the annular groove 41 is advantageous particularly in terms of the production costs.

Figure 4:
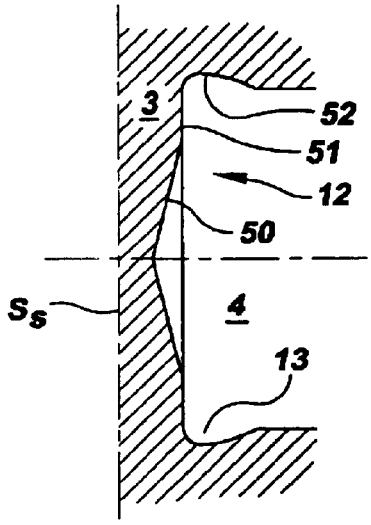
FIG. 4 shows a detail of one end face in the directional valve piston.

FIG. 4 shows a special shape of the end face 12 with the cross-sectional widening 13 of the axial bore 4 in the directional valve piston 3. The central part of the end face 12 is in the form of a very flat cone 50 with an apex angle of 150 to 170°. The conical part has adjoining it an annular surface 51 which is parallel to the axis of symmetry $S_s$ and which then merges into a surface of an ellipsoid of revolution 52 which surrounds the cross-sectional widening 13. This special shape has an advantageous influence on the flow in the axial bore 4 and constitutes means for deflecting the flow. As is known, an inflowing or outflowing jet generates an undesirable resultant axial force component when the inlet and outlet directions are different. Since the mass flows are of different size, depending on the opening cross sections of the pressure regulator and of the directional valve piston 3, the inflowing or outflowing jet has a different intensity. The above-described shape illustrated achieves a minimization of the undesirable force component.

Figure 5:
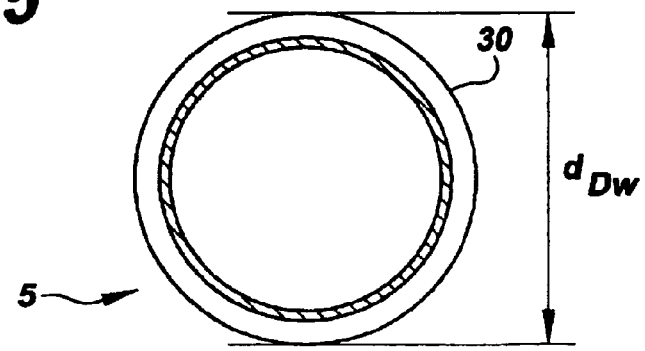
FIG. 5 shows an alternative version of one end of the pressure regulator piston.

FIG. 5 shows a design variant for that end of the pressure regulator piston 5 at which the control edge 30 is located. There are no control ribs 10 (FIG. 2) and fine control notches 11 here. Instead, the end of the pressure regulator piston 5 is chamfered conically. Thus, the outside diameter of the pressure regulator piston 5 decreases continuously from the control edge 30. This results in a control gap which becomes increasingly larger with an increasing displacement of the pressure regulator piston 5 out of the neutral position.

Figures 6A, 6B, 6C:
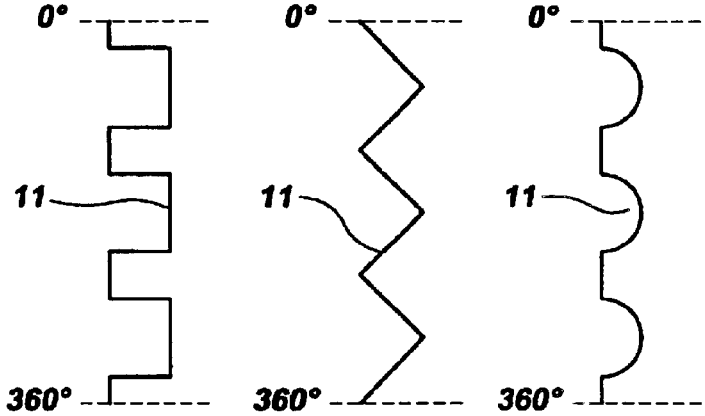
FIGS. 6*a* to *c* show further embodiments of this.

Alternative embodiments are shown in FIGS. 6*a*) to 6*c*). These figures show the 360° layout of the outer surface of the pressure regulator piston 5 in the region of the fine control notches 11. In this case, FIG. 6*a*) corresponds to the embodiment according to FIGS. 1 to 3, while FIGS. 6*b*) and 6*c*) show alternative embodiments. FIG. 6*b*) shows triangular interspaces and FIG. 6*c*) shows interspaces in the form of segments of a circle. The embodiments according to FIGS. 5 and 6*a*) to 6*c*) thus show, at the control edge 30 of the pressure regulator piston 5, means by which the dependence of the effective opening cross section during the displacement of the pressure regulator piston 5 can be influenced advantageously. In order to achieve particular opening characteristics, the various possibilities can also be combined.

FIGS. 1 and 3 show in each case only one half of the valve housing 1 and of the directional valve piston 3. It can be gathered from the symmetry with regard to the vertical axis of symmetry $S_s$ that a pressure regulator piston 5 of exactly identical form of construction is also contained in the second half, not illustrated, of the directional valve piston 3. It follows from this that, in the case of a hydraulic consumer with two working connections, each of the working connections is assigned an individual pressure regulator.

What is claimed is:

1. A directional valve with internal pressure regulator, said valve comprising:

a valve housing having a longitudinal bore in which a plurality of coaxial annular ducts are recessed, said annular ducts comprising a pump-pressure duct, a load sensing duct, and an annular tank connection duct;

a directional valve piston which is axially displaceable in said longitudinal bore, said directional valve having an axial bore with a first radial perforation, a second radial perforation which axially spaced from said first radial perforation, an annular groove adjoining said second radial perforation, and a closed end, said second radial perforation communicating with said pump pressure duct or, via said annular groove in a neutral position of said directional valve piston, with said load sensing duct;

a pressure regulator piston which is axially displaceable in said axial bore, said pressure regulator piston having a control edge, a closed end wall, an inner space with an inside diameter, and at least one radial perforation which permanently connects said inner space to said second radial perforation in said directional valve piston;

a pressure regulator spring space between said closed end wall of said pressure regulator piston and said closed end of said directional valve piston, said space containing a spring which loads said closed end wall away from said closed end; and means permanently connecting said pressure regulator spring space to said load sensing duct.

2. A directional valve as in claim 1 wherein said second radial perforation in said directional valve piston is arranged adjacent to said closed end wall of said pressure regulator piston.

3. A directional valve as in claim 1 wherein said pressure regulator piston has an end face which is opposite to said closed end wall, said control edge being arranged on said end face.

4. A directional valve as in claim 1 wherein said directional valve piston comprises a pressure relief bore which communicates with said axial bore and with said inner space of said pressure regulator piston, and which connects said axial space with said annular tank connection duct only in said neutral position.

5. A directional valve as in claim 1 wherein said axial bore of said directional valve piston comprises an end face having means for deflecting flow.

6. A directional valve as in claim 5 wherein said valve housing has an axis of symmetry, said end face of said axial bore comprising a conical central part, an annular surface which surrounds said central part and is parallel to said axis of symmetry, and a cross-sectional widening of said axial bore which is defined by an ellipsoidal surface of revolution.

7. A directional valve as in claim 1 wherein the inside diameter of the inner space of the pressure regulator piston is dimensioned so that the cross-sectional area of the inner space is 3 to 5 times the area of the second radial perforation of the directional valve piston.

8. A directional valve as in claim 1 wherein said control edge of said pressure regulator piston is shaped to influence the dependence of the opening cross section on displacement of said pressure regulator piston.

* * * * *